United States Patent [19]

Edward et al.

[11] Patent Number: 4,825,220

[45] Date of Patent: Apr. 25, 1989

[54] MICROSTRIP FED PRINTED DIPOLE WITH AN INTEGRAL BALUN

[75] Inventors: Brian J. Edward, Jamesville; Daniel F. Rees, Camillus, both of N.Y.

[73] Assignee: General Electric Company, Syracuse, N.Y.

[21] Appl. No.: 935,030

[22] Filed: Nov. 26, 1986

[51] Int. Cl.[4] ..... H01Q 9/28

[52] U.S. Cl. ..... 343/795; 343/700 MS; 343/821; 343/846

[58] Field of Search ..... 343/795, 700 MS, 806, 343/807, 821, 820, 822, 859, 829, 846; 333/26

[56] References Cited

U.S. PATENT DOCUMENTS

| | | | |
|---|---|---|---|
| 3,239,838 | 3/1966 | Kelleher | 343/795 |
| 3,623,112 | 11/1971 | Rupp | 343/821 |
| 3,845,490 | 10/1974 | Manwarren et al. | 343/822 |
| 4,074,270 | 2/1978 | Kaloi | 343/700 MS |
| 4,287,518 | 9/1981 | Ellis | 343/795 |
| 4,424,500 | 1/1984 | Viola et al. | 333/26 |
| 4,500,887 | 2/1985 | Nester | 343/700 MS |
| 4,607,394 | 8/1986 | Nightingale | 455/327 |
| 4,623,894 | 11/1986 | Lee | 343/700 MS |
| 4,686,536 | 8/1987 | Allcock | 343/795 |

FOREIGN PATENT DOCUMENTS

| | | | |
|---|---|---|---|
| 1003559 | 1/1977 | Canada | 343/795 |
| 2811521 | 10/1978 | Fed. Rep. of Germany | 343/821 |

OTHER PUBLICATIONS

Edward et al., "A Broadband Printed Dipole With Integrated Balun", Microwave Journal, May 1987, pp. 339–344.

The Compensated Balun/G. Oltman 3/66 vol. MTT-14, No. 3 IEEE Transactions On Microwave Theory and Techniques (pp. 112–119).

Printed Circuit Balun For Use With Spiral Antennas/R. Bawer and J. J. Wolfe May 1960 IRE Transactions on Microwave Theory and Techniques (pp. 319–325).

A New Wide-Band Balun/W. K. Roberts Dec. 1957 Proceedings of the IRE (pp. 1628–1631).

*Primary Examiner*—William L. Sikes

*Assistant Examiner*—Hoanganh Le

*Attorney, Agent, or Firm*—Richard V. Lang; Carl W. Baker; Fred Jacob

[57] ABSTRACT

A microstrip fed printed dipole with an integral balun is disclosed, fabricated upon a planar dielectric substrate by patterning metallizations disposed on the two surfaces of the substrate. In the arrangement, the ground plane of the unbalanced microstrip transmission line is bifurcated by a central slot to form a balanced transmission line coextensive with the slot which becomes a part of the arms of the dipole and which at the same time serves as the ground plane of a continuation of the microstrip feed. A continuation of the strip conductor of the unbalanced microstrip feed having a "J" shaped configuration continues over the bifurcated ground planes and crosses the slot in proximity to the dipole for effecting an efficient unbalanced feed to the balanced dipole. The arrangement has a double tuned characteristic with two available and independent adjustments facilitating reproducable, optimized broadband performance.

6 Claims, 3 Drawing Sheets

MICROSTRIP FED PRINTED DIPOLE WITH AN INTEGRAL BALUN

BACKGROUND OF THE INVENTION

1. Field of the Invention

The invention relates to a dipole antenna useful as a radiating element in microwave and millimeter wave phased arrays, and more particularly to a printed dipole antenna with an integral balun which is useful when active circuitry is employed with each radiating element.

2. Prior Art

Dipole radiating elements with baluns for use in phased arrays have been fabricated in either a coaxial or stripline media. The coaxial versions require machined or cast metal components and either manual or specialized machine assembly. Consequently the coaxial designs tend to be relatively high in weight and cost. The coaxial dipole/balun designs require an electrical transition for interconnection to microstrip active circuitry (which has a single ground plane) and are not generally integratable with the active circuitry packaging.

Stripline dipole/balun designs, because of their printed/photolithographic fabrication process, can achieve low weight and costs. However, their double electrical ground plane complicates their utilization, and an electrical transition is required for interconnection to microstrip active circuitry (with a single ground plane) which impairs their performance. In addition, the materials usually employed for the stripline designs preclude their direct integration with the active circuitry package.

Printed microstrip "patch" type antennas are often proposed as radiating elements in active phased arrays. Patches may be directly printed with microstrip active circuitry, however, the semiconductor materials have relatively high dielectric constants which severely limit the patches' operating bandwidths. Alternatively, the patch may be integrated as part of the active circuitry package. The package materials tend to be thin and also possess high dielectric contants, both of which are detrimental to a patch's bandwidth.

A balun in a coaxial realization has been described by Roberts in an article entitled "A New Wide Band Balun," Proceedings IRE, Vol. 45, Dec. 1957, pp. 1628–1631. A printed circuit variation has been described by Bawer and Wolfe in an article entitled "A Printed Circuit Balun for Use with Spiral Antennas," IRE Trans. on Microwave Theory and Techniques, Vol. MTT-8, May 1960, pp. 319–325.

The Roberts, Bawer, and Wolfe articles describe how the balun structure can provide a broadband response when feeding a frequency independent real load. An article by Oltman entitled "The compensated Balun," IEEE Trans. on Microwave Theory and Techniques, Vol. MTT-14, March 1966, pp. 112–119, discusses the concept of selecting the characteristic impedances of the lines which comprise the balun to achieve a complementary match to a frequency dependent load impedance over a limited band.

With respect to the prior art array elements, the need has arisen for a broadband microstrip fed dipole/ balun which is light in weight, low in cost, and which can be directly interfaced with active microstrip circuitry and integrated with active circuitry packaging.

SUMMARY OF THE INVENTION

Accordingly, it is an object of the present invention to provide an improved microstrip fed printed dipole with an integrated balun.

It is another object of the present invention to provide a microstrip fed printed dipole with an integrated balun having improved broadband response.

It is still another object of the present invention to provide a microstrip fed printed dipole with an integral balun in which a desirable response is readily reproduced.

These and other objects of the invention are achieved in a novel microstrip fed printed dipole with an integral balun. The arrangement is fabricated upon a planar dielectric substrate typically of fused silica with a first patterned metallization layer disposed on the under surface and a second patterned metallization layer disposed on the upper surface.

An unbalanced microstrip transmission line, which is used to feed or be fed from the antenna, is formed by patterning the first metallization to form the ground plane and the second metallization to form the strip conductor.

The dipole radiating element is formed by patterning the first metallization to form the dipole arms.

The transition from microstrip to dipole is also formed by patterning the two metallizations. A continuation of the ground plane is bifurcated by a central slot extending toward the dipole into a first and a second ground plane, the bifurcated ground plane also forming a balanced transmission line coextensive with the slot. A contination of the strip conductor forms a three part strip conductor disposed over the bifurcated ground planes to continue the unbalanced transmission line, the three part strip conductor having a "J" shaped configuration.

The dipole radiating element is formed as a diverging extension of the first and second bifurcated ground planes with the inner portions of the arms of the dipole underlying and being strongly coupled to the "J" shaped strip conductor with the outer portions of the arms extending beyond the strip conductor for efficient radiation.

In accordance with a further aspect of the invention, the balanced transmission and "J" shaped microstrip lines have characteristic impedances matching that of the dipole at resonance. Double tuned broadband performance is obtained by setting the electrical length of the unbalanced transmission line, which length is measured from the slot to the open circuited end to approximately one-quarter wavelength so as to provide a low shunt RF impedance to unbalanced mode currents at the dipole load. The electrical length of the balanced transmission line is set to approximately one-quarter wavelength so as to provide a high shunt RF impedance to balanced mode currents at the dipole load, the design facilitating the flow of RF current supplied from the microstrip transmission line in an unbalanced mode through the dipole arms in a balanced mode in transmission, the reverse occurring in reception.

The arrangement greatly facilitates reproducable performance since the frequency of the double tuned elements may be adjusted by deepening the slot or shortening the length of the third part of the microstrip conductor—both adjustments being independent and readily achieved by laser trimming.

DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

FIGS. 1A and 1B are illustrations of a microstrip fed printed dipole with an integral balun in accordance with the invention, FIG. 1A being in perspective and FIG. 1B being a plan view;

DESCRIPTION OF THE PREFERRED EMBODIMENT

Figure 1B:
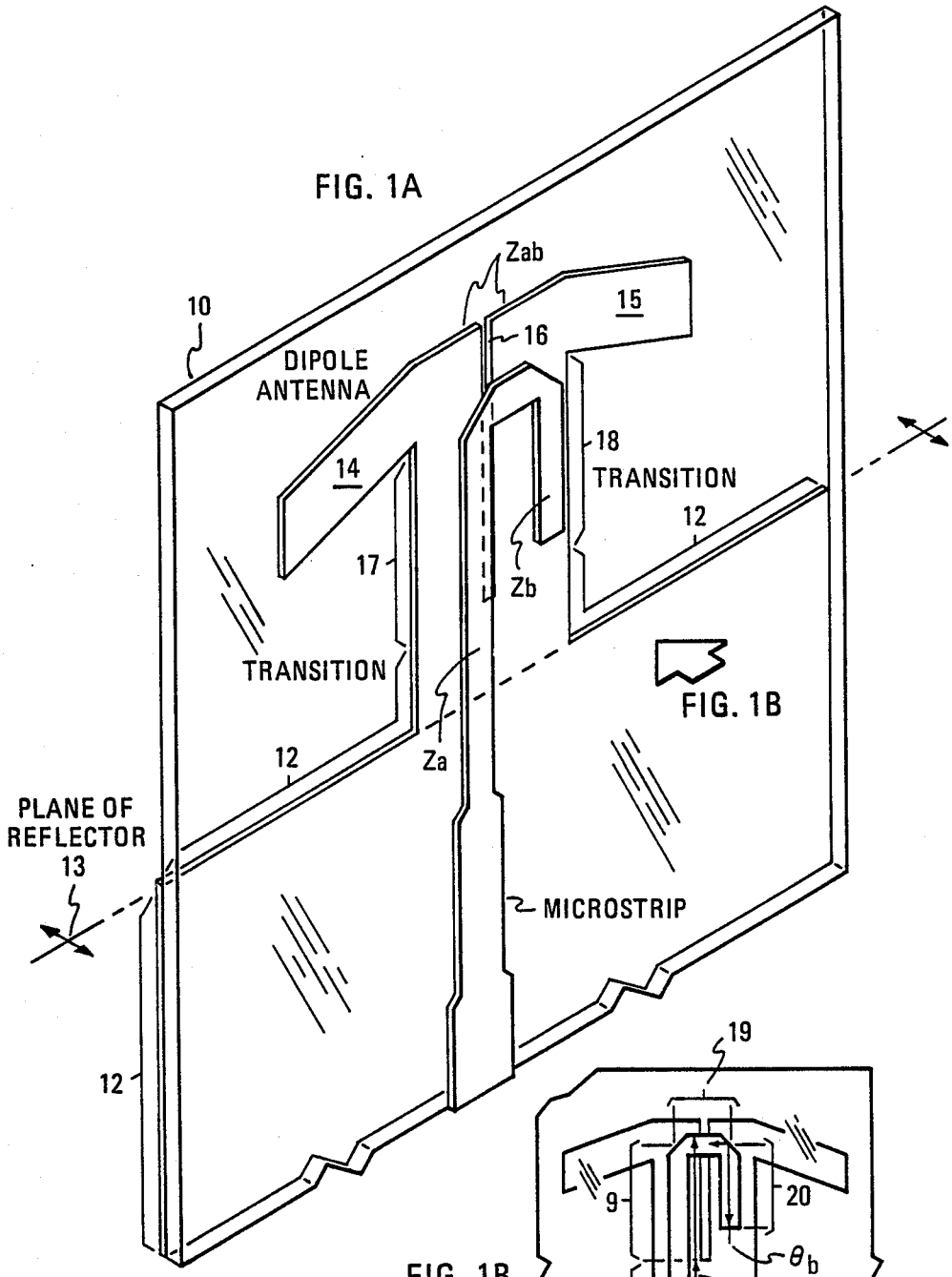

Referring now to FIGS. 1A and 1B, a microstrip fed printed dipole with an integral balun is shown in a perspective drawing. The arrangement consists of a planar dielectric substrate 10 supporting on its under-surface a first patterned metallization, and on its uppersurface, a second patterned metallization. In a practical embodiment, the dielectric material is fused silica 0.64 millimeters thick and the metallizations are "printed" layers on the order of a hundredth of a millimeter (200 micro inches to 2/1000th of an inch depending on the process) in thickness.

For convenient discussion, the arrangement may be divided into three functional regions progressing from the bottom to the top of the figures. The lower-most region in the illustrations is assigned to the unbalanced microstrip feed; the upper-most region is assigned to the balanced dipole radiating element; and the intervening second region is assigned to the transition from the unbalanced microstrip to the balanced dipole antenna.

The microstrip feed consists of a ground plane 12 provided by the under-surface metallization and a relatively narrow strip conductor 11 patterned from the upper-surface metallization. At the lowest position in the illustration, the strip conductor is somewhat wider to achieve a standard transmission line impedance of 50 ohms. The strip conductor is then stepped down in an impedance transformer to transform the conventional 50 ohm microstrip impedance at the bottom of the illustration via a one-quarter wavelength long 63 ohm section to the 80 ohm value required to match the impedance at resonance of the dipole antenna.

At the bottom of the illustration, the ground plane 12 of the microstrip has a transverse dimension at least ten times the transverse dimension of the strip conductor above it. The ground plane 12 then passes through the plane of a conductive reflector 13 selected to be one-quarter of a freespace wavelength behind the dipole to give an optimal forward radiation pattern. The ground plane emerges above the reflector with a width reduced to about six times the width of the strip conductor. The transverse dimensions of conductors 11 and 12, the substrate thickness and dielectric constant above the plane of the reflector, continue to match the impedance of the microstrip transmission line to the aproximately 80 ohm impedance of the dipole at resonance.

The transition between microstrip and dipole, which is depicted in FIGS. 1A and 1B, may be summarized as follows. The ground plane of the microstrip is bifurcated by a slot 16 to form two ground planes 17,18 which form a balanced transmission line coupled to the dipole. At the same time, the strip conductor 11 of the microstrip merges into three conductor segments (9,19,20) to form a "J" shaped strip conductor which is disposed over the members 17 and 18 acting as ground planes to complete an unbalanced microstrip transmission line, coupled to the dipole.

The uppermost region is the dipole radiating element which forms the balanced load. The dipole comprises two arms, separated by a small gap and each extending transversely away from the gap for approximately one-quarter of a freespace wavelength. The inner portions of the arms underlie the second part of the "J" shaped strip conductor, and the outer portions of the arms extend beyond the second part for efficient radiation. The dipole arms droop toward the reflective surface 13 to reduce coupling to adjacent dipoles, it being intended that the dipole will be used in a larger two dimensional array of like dipoles, with the reflective surface 13 providing optimum broadside energy radiation.

The intervening second region of the arrangement, which will now be discussed in detail, provides the microwave transmission paths which efficiently match the unbalanced microstrip to the balanced dipole antenna.

The transitional second region commences approximately one-third of the distance from the reflector 13 to the dipole arms. This position is defined by the bottom of a slot 16 in the ground plane metallization dividing it into two equal width metallizations 17,18 and permitting balanced operation. The strip conductor 11 is centered (laterally) over the metallization 17 and sufficiently displaced from metallization 18 as to be decoupled from it. The metallizations 17,18 continue toward the dipole, mutually separated by the slot 16 until they merge into the arms of the dipole. The two metallizations 17,18 spaced by the slot 16 thus form a balanced transmission line whose electrical length is somewhat less than the axial extent of the slot, and whose characteristic impedance is established by the width of the slot, the width of the metallizations 17,18, and the thickness and dielectric constant of the supporting substrate. The electrical length of the balanced transmission line (the quantity theta ab) is more nearly equal to the distance from the base of the slot 16 to the half width of the dipole arm. The upper limit is close to the upper extremity of the "J" shaped strip conductor and approximates the electrical position of the dipole load presented to the balanced line. When properly driven, the two balanced conductors 17,18 which merge into the dipole areas, can provide a balanced transmission path to and from the dipole.

Unbalanced microstrip transmission from the microstrip at the bottom of FIGS. 1A and 1B continues through the transition to the dipole at the top of FIGS. 1A and 1B. In the transition, the strip conductor of the microstrip starts with the upper end of strip conductor 11 and includes segments 9, 19 and 20, the combination forming a "J" shaped conductor over the relatively wide underlying metallizations. The strip conductor 11 merges into the segment 9, which is the first segment in the transition. Segment 9 retains the same transverse dimensions as conductor 11, as it proceeds parallel to the slot 16 and over the underlying metallization 17. The metallization 17 has approximately three times the transverse dimension of the segment 9 and thus the first microstrip portion in the transition continues to have an approximately 80 ohms characteristic impedance. Unbalanced transmission continues, supported by the segment 9 and ground plane 17, to a position where segment 9 overlies the inner surfaces of the dipole arms. Here, the segment 9 merges into the contiguous segment 19 of the strip conductor.

Unbalanced transmission continues via the segment 19 and the underlying metallizations. The portion 19 extends transversely from a point transversely centered over the left half ground plane 17 to a point transversely centered over the right half ground plane 18. At the corners where 9 and 19 join, and 19 and 20 join, a 45 degree narrowing of the microstrip occurs. The tapered corner is designed to facilitate the change in direction of the currents in the two portions of the strip conductor with minimum impedance change and therefore minimum reflection.

The transverse strip conductor 19 is disposed over a ground plane of adequate width to maintain unbalanced microstrip transmission and the 80 ohm impedance of the microstrip. The metallizations underlying conductor 19 include portions of ground plane metallizations 17,18 merging into the arms 14,15 of the dipole. The underlying dipole metallizations extend a distance equal to the width of the strip conductor beyond the upper edge of the strip conductor; and the metallizations 17 and 18, which merge into the dipole arms 14 and 15, extend a distance equal to several strip widths below the lower edge of the strip conductor.

The final portion of the microstrip comprising the strip conductor segment 20 and the underlying metallization 19 also supports unbalanced microstrip transmission. The third segment 20 in the transition merges into the end of segment 19, being oriented with its axis parallel to the slot and extending toward the reflective surface 13. It is disposed along a line lying over the center line of the right ground plane 18, and it is terminated before reaching the vertical coordinate of the bottom of the slot 16.

The strip conductor (11, 9, 19, 20) thus takes on the appearance of an inverted "J". The stem of the "J" is a portion of segment 11 and segment 9 over the left half of the divided ground plane. The bottom of the "J" is the segment 19 crossing the slot at the base of the dipole. The upward hook of the "J" is the last segment 20 of the strip conductor positioned over the right half of the divided ground plane.

The arrangement as just described, will accordingly support both balanced transmission and unbalanced transmission in the region which transitions between the microstrip and the dipole. If the balanced line formed by the underlying metallization has an electrical length (theta ab) of one-quarter wavelength from the base of the slot to the point of maximum drive at the dipole, then the remote short circuit occasioned by the bottom of the slot will be transformed at the point of connection to the dipole to a high balanced mode impedance. The high balanced mode impedance supports a voltage maximum at the dipole to facilitate dipole excitation.

Similarly, if the portion of the microstrip transmission line comprising strip conductor 19 and 20 disposed over ground plane 18 ends in an open circuit and the electrical dimension (theta b) from the open circuit end to the slot 16 is made equal to one-quarter wavelength, then the open circuit of the microstrip will be transformed to a low unbalanced mode impedance at the slot. This impedance is the microstrip impedance existing between the strip conductor 19 and the underlying portions 17 and 18.

Accordingly, when rf current flows in the unbalanced microstrip, and the left conductor of the balanced line is driven in a first or reference phase then the right conductor of the balanced line, due to the difference in the phase of the wave as it proceeds along the strip line, will be driven out of phase with reference phase, and a balanced dipole drive results.

The practical design depicted in FIGS. 1A and 1B permits double tuning of the dipole-balun impedance yielding a bandwidth in excess of 40% while maintaining a voltage standing wave ratio (VSWR) of less than two to one. The tuning for optimized performance is readily accomplished and the adjustments are substantially independent allowing one to obtain a desired transfer characteristic. Assuming that broadband operation is the primary objective, adjustment of the electrical length of the quantities theta b and theta ab effect this objective.

Both the quantities theta a and theta ab are accessible in a working unit for adjustment to precise values. The measurements may be made on operating units should that degree of precision be desired. The quantity theta b as earlier stated, is the electrical length of the microstrip defined by the strip conductors 19 and 20 along a path measured from the slot 16 at one end to the end of the strip conductor 20 at the other end. The end of the strip conductor 20 is an electrical open circuit and is unconnected. This end may readily be adjusted to bring about an adjustment of the quantity theta b. The quantity theta ab is also easily adjusted as earlier stated, it is measured from the base of the slot 16 to the point of load connection at the dipole. Thus, it may be readily adjusted by adjusting the depth of the slot.

If a single design is required, then these dimensions may be calculated, tested, and trimmed, and the final value used repetitively thereafter. However, if slight design variations are required, such as when used as an element in a phased array, being located in a center position or an edge position, then the quantities theta b and theta ab may both be adjusted on each item by conventional (laser) trimming. In the case where laser trimming is contemplated, the quantity theta b is made slightly larger than the expected final value and the quantity theta ab is made slightly lower than the expected final value, and both values may be accurately adjusted toward the correct value by the removal of material by a laser trimmer.

Figure 3:
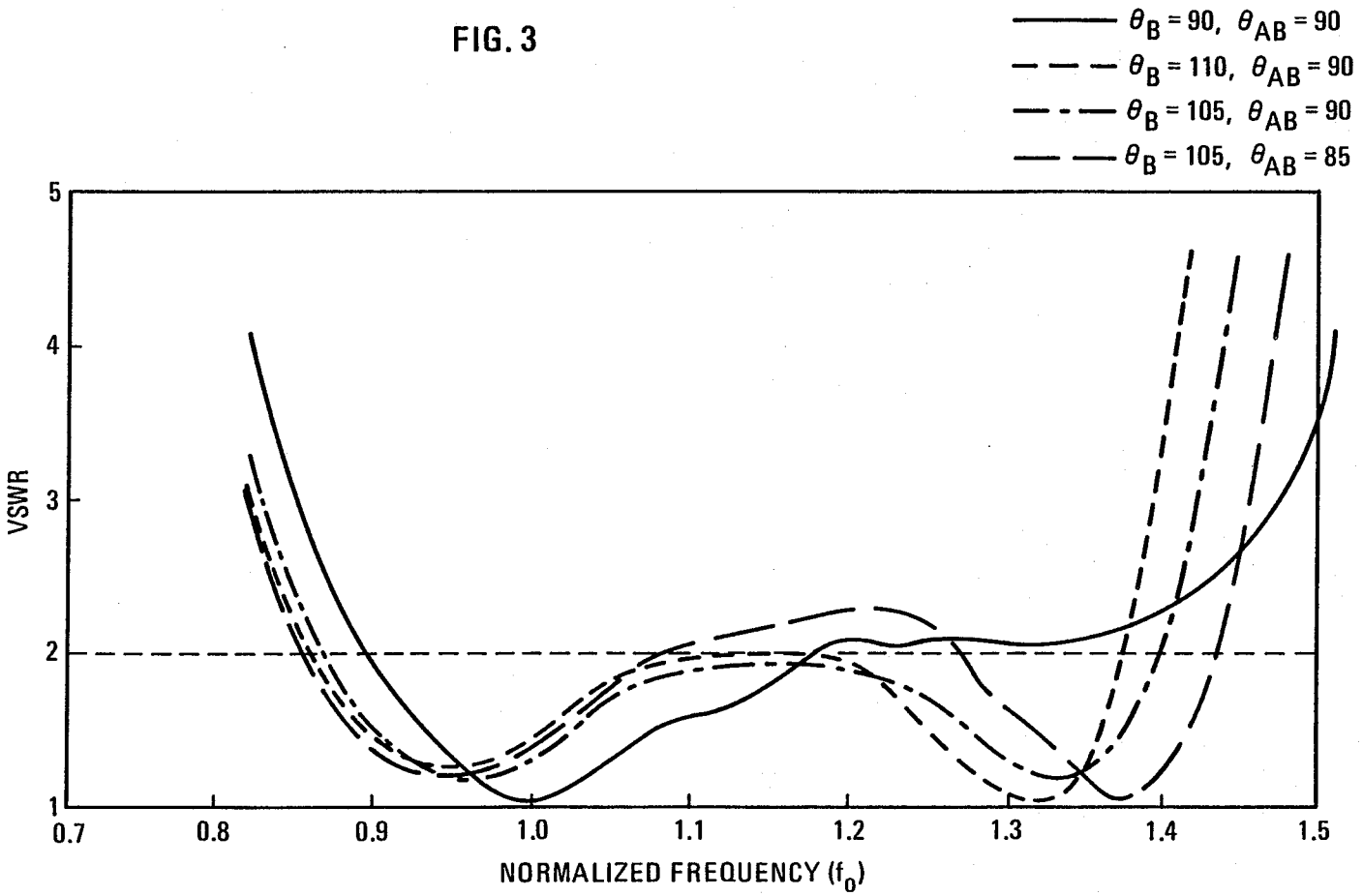
FIG. 3 is a graph of the calculated voltage standing wave ratios (VSWRs) of embodiments of the invention which illustrates the effect on bandwidth of variation in the values of two electrical parameters which are conveniently and independently set by simple mechanical measures.

A graph of the VSWR using calculated data plotted against normalized frequency for differing values for theta b and theta ab is illustrated in FIG. 3. The graph with minimum bandwidth (while maintaining a VSWR of less than two), occurs when theta b and theta ab are both equal to 90 degrees. The bandwidth is still a relatively broad 20 degrees, continuing from 0.9 to 1.17 of the normalized frequency.

Figure 4:
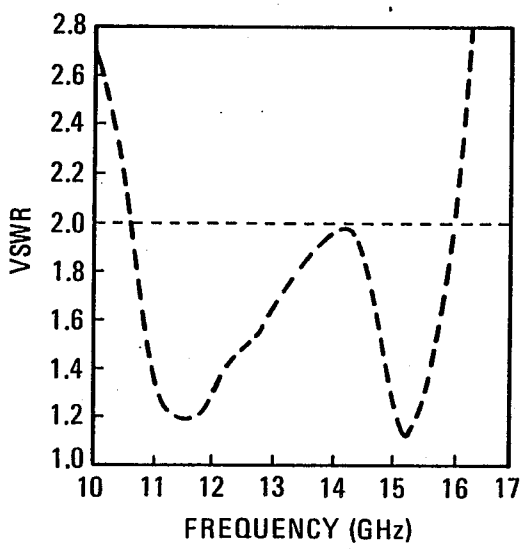
FIG. 4 is a graph of the measured VSWR performance of an embodiment of the invention.

If the quantity theta b is adjusted to a value in excess of 90 degrees then a double hump appears and the bandwidth for a VSWR of less than two increases by a factor of nearly two. The broadest curve, which meets the VSWR criterion, is the curve in which the quantity theta b is 105 degrees and the quantity theta ab is 90 degrees. If theta ab is allowed to fall slightly below 90 degrees, e.g. 85 degres, broader performance is achieved, at the sacrifice of the VSWR in the middle of the graph. The computed graph of FIG. 3 thus represents a response curve typical of conventional double tuned circuits. Measured performance of a practical embodiment designed for 11–16 gHz operation is illustrated in FIG. 4. The illustration confirms the mathematical analysis, and shows broad relative bandwidth of approximately 40%.

Figure 2A:
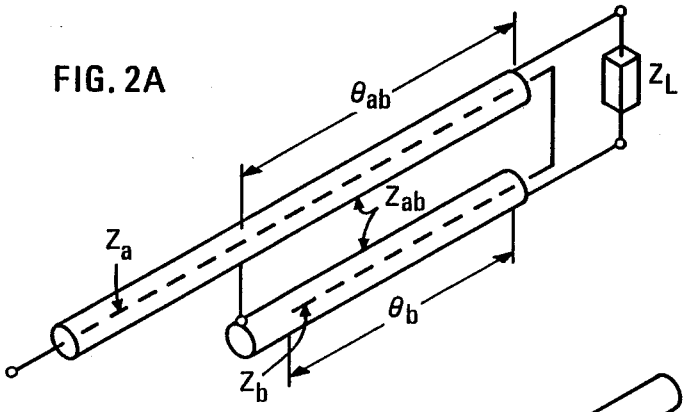
FIG. 2A is an illustration of a known coaxial balun structure.

The mathematical analysis of a coaxial balun of the type suggested in FIG. 2A has been provided in an article by W. K. Roberts published in the proceedings of the IEEE December 1957 entitled "A New Wideband Balun", Vol. 45, pages 1628 to 1631.

Figure 1B:
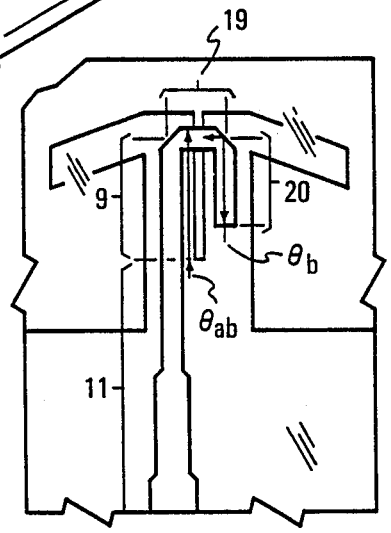

The actual coaxial balun being analyzed was formed of a branched coaxial transmission line (FIG. 1 of the article) in which the coaxial shield was formed into a "Y" with the branched arms being of specified electrical length and remaining physically parallel. The unbalanced feed point of the balun is the stem of the "Y" and the balanced load is connected to the shields at the load ends of the arms of the "Y". The central conductor is continued from the feed point of the stem of the coaxial line into one branch but interrupted into the other branch. However, the central conductors in the arms are connected togetrher at the load ends.

Figure 2B:
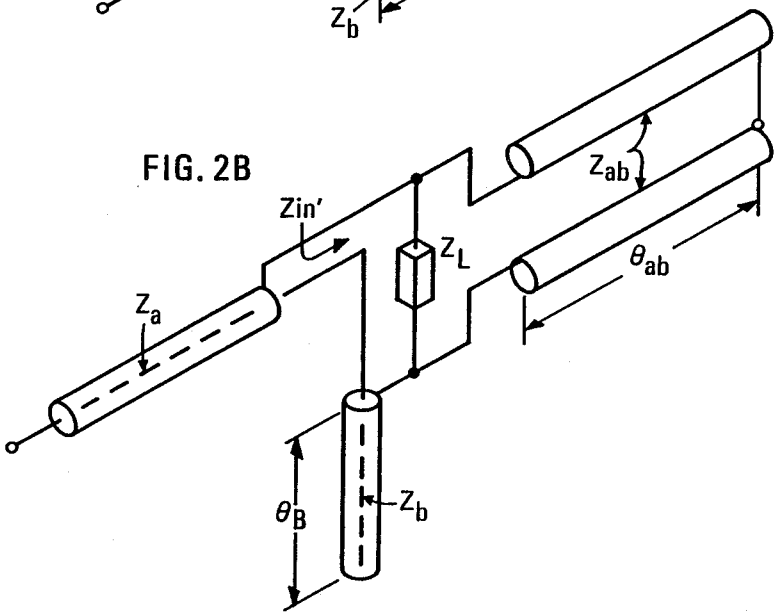
FIG. 2B is an equivalent circuit representation of the FIG. 2A coaxial balun structure.

The published analytical description of the balun required two extrapolations from the actual physical realization. FIG. 2A represents a first redrawing of the balun as two coaxial lines having the electrical properties of the actual branched balun. FIG. 2B illustrates a further redrawing of the actual physical realization. FIG. 2B is an equivalent circuit description which is capable of a mathematical characterization of the balun. The parameters entering into the description are the characteristic impedances of the first coaxial line Za, the characteristic impedance Zb of the stub, the electrical length of the unbalanced coaxial stub theta b; and the quantities theta ab and Zab which are respectively the electrical length and characteristic impedance of the balanced transmission line formed by the parallel shields of the coaxial lines. The load impedance is Zl.

As seen in FIG. 2B, the (unbalanced) coaxial transmission line forms a series open circuited stub with the load impedance, Zl, while the outer conductors of the coaxial transmission lines having characteristic impedances Za and Zb form a shunt short circuited balanced line stub of characteristic impedance Zab. From an inspection of the equivalent circuit, the impedance Zin', of the balun structure is readily expressed as follows:

$$Zin' = -jZb \cot \text{theta } B + \frac{jZl\,Zab \tan \text{theta } ab}{(Zl + jZab \tan \text{theta } ab)} \quad [1]$$

where theta b represents the electrical length of the open circuited series stub, and theta ab represents the electrical length of the short circuited shunt stub.

In accordance with the invention herein described, substrate supported microstrip conductors replace the unbalanced coaxial transmission lines of Roberts. The ground plane for the microstrip conductors are printed so as to form a balanced transmission line analogous to the outer shields of a coaxial line.

In the microstrip realization, the realizable spacing between the balanced line conductors limits the lower extreme of Zab while the three times microstrip ground plane width constraint, limits the lower extreme of Za and Zb and the upper extreme of Zab. The actual characteristic impedances selected for these transmission lines is influenced by the supporting substrate's dielectric constant and thickness with values between 60 and 100 ohms being typical.

Both analytical and practical data confirm that the microstrip arrangement herein described may be designed to provide the double peaked characteristic like that of a pair of over-coupled tuned circuits. This is brought about by a judicious selection of the length of the microstrip line (theta b) and the balanced line (theta ab). Using Equation 1 with Zl as the dipole's impedance and the characteristic impedances Zb and Zab set equal to the dipole's resonant resistance of 80 ohm, the combination balun/dipole impedance has been calculated as a function of theta b, theta ab, and frequency. The results of this calculation in terms of VSWR with respect to the dipole's resonant resistance of 80 ohms are represented in FIG. 3, which has been earlier discussed.

What is claimed is:

1. A microstrip fed printed dipole with an integral balun comprising:

a planar dielectric substrate having a first metallization layer disposed on the under surface and a second metallization layer disposed on the upper surface, (1) an unbalanced microstrip transmission line with a ground plane formed from said first metallization and a strip conductor formed from said second metallization, (2) a dipole radiating element having two spaced arms formed from said first metallization and exhibiting a first impedance at resonance, and (3) a transition in which a continuation of the ground plane of said unbalanced transmission line is bifurcated by a central slot extending to the arms of said dipole to form a first and a second ground plane, the bifurcated ground planes forming a balanced transmission line coextensive with the slot and exhibiting a characteristic impedance approximately matching said first impedance, and a continuation of the strip conductor of said unbalanced transmission line forming a three part strip conductor disposed over said bifurcated ground planes to continue said unbalanced transmission line, the continuation of said unbalanced transmission line exhibiting a characteristic impedance approximately matching said first impedance, said three part strip conductor having a "J" shaped configuration, a first part continuing over said first bifurcated ground plane toward said dipole radiating element, a second part extending across said slot over said dipole from said first bifurcated ground plane to said second bifurcated ground plane, and a third part extending back toward said unbalanced transmission line and ending in an open circuit, said dipole radiating element being formed as a diverging extension of said first and second bifurcated ground planes, the inner portions of the arms of said dipole underlying and strongly coupled to said second part, and the outer portions of said arms extending beyond said second part for efficient radiation, and wherein:

the electrical length (theta b) of said unbalanced transmission line, measured from said slot to said open circuited end is approximately one-quarter wavelength so as to provide a low shunt RF impedance to unbalanced mode currents at the dipole load (Zl), and the electrical length (theta ab) of said balanced transmission line measured from the base of the slot to the half width of the dipole arm is approximately one-quarter wavelength so as to provide a high shunt RF impedance to balanced mode currents at the dipole load, thereby facilitating the conversion of RF current flowing in an unbalanced mode in said microstrip transmission line to a balanced mode in the dipole arms in transmission, the reverse occurring in reception.

2. The arrangement set forth in claim 1 wherein the characteristic impedance of said balanced line is set equal to the dipole impedance at resonance, and the characteristic impedance of said continuation of said unbalanced line is set equal to the dipole impedance at resonance, and the electrical length of at least one member of the set theta b and theta ab is displaced from 90 electrical degrees to effect a double tuned, broadband characteristic.

3. The arrangement set forth in claim 2 wherein the quantity theta b is adjusted above 90 degrees for broadbanding.

4. The arrangement set forth in claim 2 wherein the quantity theta b is adjusted above 90 degrees and theta ab is adjusted below 90 degrees for broadbanding.

5. The arrangement set forth in claim 2 wherein the quantity theta b is adjusted by trimming the length of said third part of said second metallization, and the quantity theta ab is adjusted by trimming the depth of said slot in said first metallization.

6. The arrangement set forth in claim 1 wherein the characteristic impedance of said balanced line is set equal to the dipole resonant impedance, and the characteristic impedance of said continuation of said unbalanced line is set equal to the dipole resonant impedance, the arrangement facilitating adjustment of the electrical length theta b by selection of the length of said third part of said unbalanced transmission line, and adjustment of the electrical length theta ab by selection of the depth of said slot, said adjustments being substantially independent and permitting optimal electrical performance.

* * * * *